US008276738B2

(12) United States Patent
Gonzalez Alemany et al.

(10) Patent No.: US 8,276,738 B2
(45) Date of Patent: Oct. 2, 2012

(54) DRIVE SYSTEM FOR ESCALATORS AND MOVING WALKWAYS

(75) Inventors: Miguel Angel Gonzalez Alemany, Oviedo (ES); Alberto Pello Garcia, Piedras Blancas (ES)

(73) Assignees: Thyssenkrupp Elevator Innovation Center, S.A., Gijon, Asturias (ES); Thyssenkrupp Elevator (ES/PBB) GmbH, Essen (DE)

( * ) Notice: Subject to any disclaimer, the term of this patent is extended or adjusted under 35 U.S.C. 154(b) by 0 days.

(21) Appl. No.: 12/979,003

(22) Filed: Dec. 27, 2010

(65) Prior Publication Data

US 2011/0155538 A1 Jun. 30, 2011

(30) Foreign Application Priority Data

Dec. 29, 2009 (ES) ..... 200931290

(51) Int. Cl.
*B66B 21/00* (2006.01)

(52) U.S. Cl. ..... 198/330

(58) Field of Classification Search ..... 198/322, 198/330, 331, 332

See application file for complete search history.

(56) References Cited

U.S. PATENT DOCUMENTS

| | | | | |
|---|---|---|---|---|
| 4,082,173 | A * | 4/1978 | Simon-Kochloffel | 198/330 |
| 4,895,240 | A * | 1/1990 | Bruehl et al. | 198/331 |
| 6,702,094 | B2 * | 3/2004 | Ishikawa et al. | 198/330 |
| 6,832,678 | B2 * | 12/2004 | Ogura et al. | 198/322 |
| 6,974,018 | B2 * | 12/2005 | Lunardi et al. | 198/331 |
| 7,219,784 | B2 * | 5/2007 | Fargo | 198/330 |
| 7,341,139 | B2 | 3/2008 | Aulanko et al. | |
| 7,353,932 | B2 | 4/2008 | Aulanko et al. | |
| 7,568,571 | B2 * | 8/2009 | Ogimura et al. | 198/332 |
| 7,665,595 | B2 * | 2/2010 | Matheisl et al. | 198/330 |
| 7,686,152 | B2 * | 3/2010 | Gonzalez Alemany et al. | 198/330 |
| 7,926,641 | B2 * | 4/2011 | Gonzalez Alemany et al. | 198/330 |
| 7,954,619 | B2 * | 6/2011 | Nurnberg et al. | 198/330 |
| 7,975,838 | B2 * | 7/2011 | Reist | 198/833 |
| 7,997,400 | B2 * | 8/2011 | Gonzalez Alemany et al. | 198/334 |
| 8,083,048 | B2 * | 12/2011 | Ishikawa et al. | 198/326 |

FOREIGN PATENT DOCUMENTS

WO WO 2008/042392 5/2005

* cited by examiner

*Primary Examiner* — Douglas Hess
(74) *Attorney, Agent, or Firm* — Merchant & Gould P.C.

(57) ABSTRACT

Drive system for escalators and moving walkways, comprising a set of wheels (3) carrying free-rotating rollers (4), with parallel axes to that of the wheels, and one or more shafts (5) perpendicular to the movement direction of the belt of steps or pallets (1), in which said roller wheels are mounted. The shafts (5) and wheels (3) are arranged between the moving forward way and the return way of the belt of steps or pallets (1). The wheels (3) engage through the rollers (4) with the steps or pallets (1) through engaging formations (7) of said belt of steps or pallets (1). The shafts (5) connect to a driving assembly through a transmission mechanism.

11 Claims, 7 Drawing Sheets

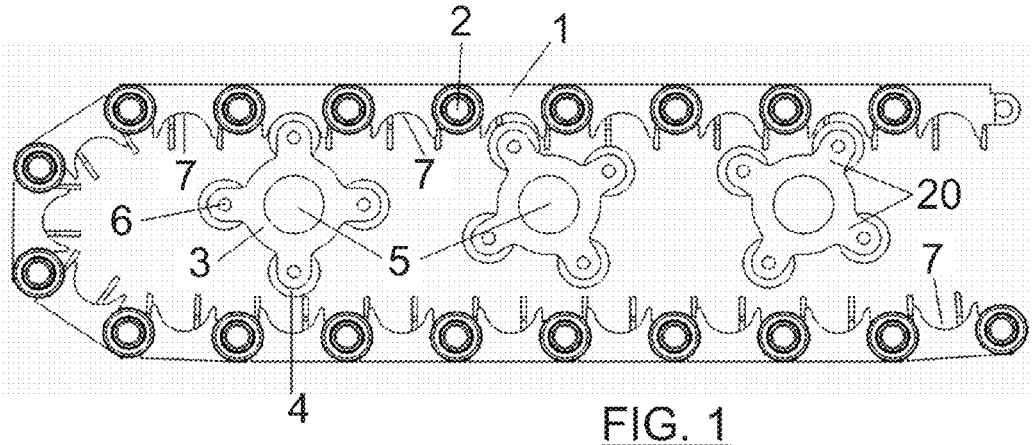
FIG. 1
FIG. 2
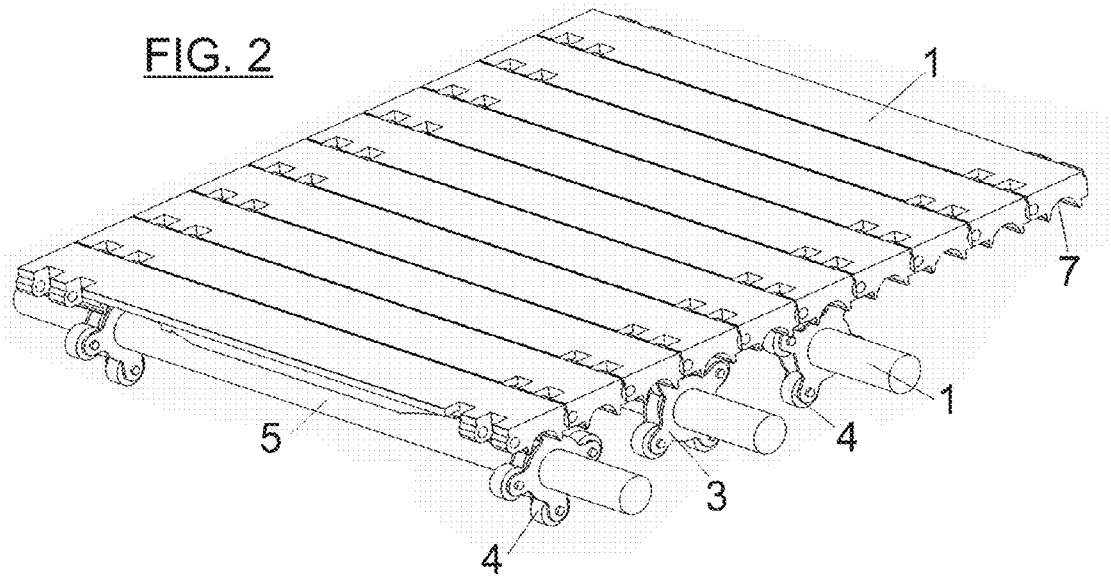

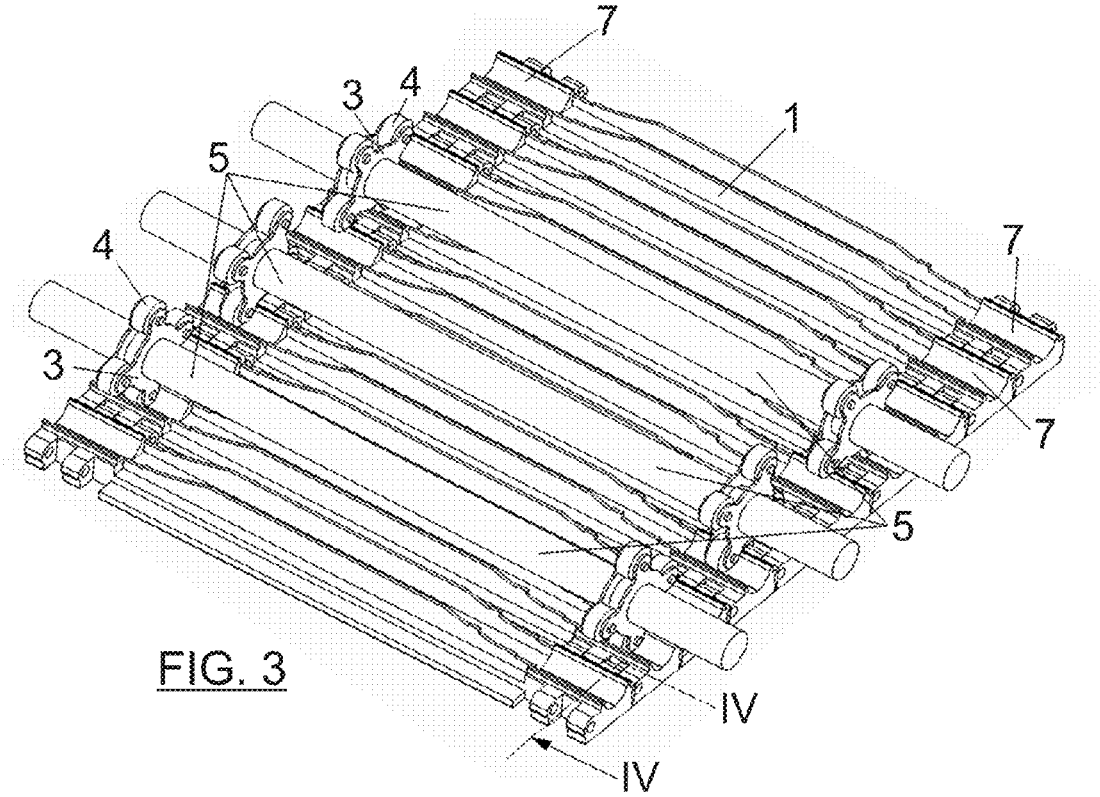
FIG. 3
FIG. 4
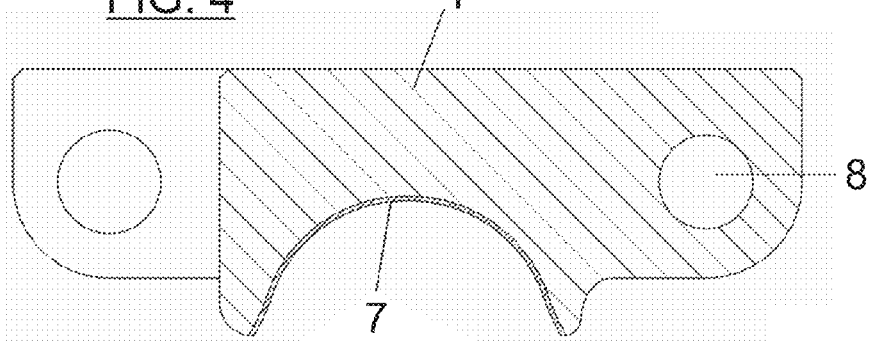

DRIVE SYSTEM FOR ESCALATORS AND MOVING WALKWAYS

This application claims benefit of Serial No. 200931290, filed 29 Dec. 2009 in Spain and which application is incorporated herein by reference. To the extent appropriate, a claim of priority is made to the above disclosed application.

FIELD OF THE INVENTION

The present invention refers to a drive system for escalators and moving walkways, and more specifically to escalators and moving walkways used for the transportation of people and goods and which are constituted by an endless belt of steps or pallets, which move on lateral guides.

Traditional escalators and moving walkways for the aforementioned purpose comprise a set of steps or pallets which move on guides, which are fastened and fit on a structure supporting the weight of the components and users. Also, the escalators and moving walkways have a crystal or opaque balustrade, fastened as well to the bearing structure, and on which a handrail moves at the same speed as the pallets.

BACKGROUND OF THE INVENTION

In the escalators and moving walkways of the type indicated the steps or pallets are traditionally driven by a chain, integral to the pallets, which goes through the entire walkway and is engaged in a toothed axis driven by an electric gear motor. Said motor is in turn driven by a vulcanized pulley constituting the traction of the handrail. These mechanisms are located in one of the ends of the rolling walkway. Other mechanisms necessary to tighten the chain and the handrail will be located at the other end. The turnover of the pallets or steps takes place in these end areas of the handrail, said pallets or steps which go through the entire length of the moving walkway or escalator on the lower part, completing the return path.

In the last few years there have arisen a series of new designs which, particularly in the case of moving walkways, intend to reduce the maximum height of the machine, which is why the conventional drive system needs to be modified.

There exist several solutions which have been chosen according to the concept of moving walkway being used. One of these solutions is detailed in international patent WO 05042392 from Kone Corporation, according to which the drive system is located, at least partially, inside the balustrade, which is possible through the use of a flat motor. Thereafter, the drive occurs through a series of belts or chains which finally drive the pallet chain, which has a short step to be able to turn in the small space available, but it otherwise operates as a conventional chain of a moving walkway.

The U.S. Pat. No. 7,341,139, also from Kone Corporation, describes the drive of a handrail and its joining to the motor system and to the drive of the pallets. The U.S. Pat. No. 7,353,932, from Kone Corporation, describes the arrangement of a pallet belt and the possible use of two driving motors simultaneously.

The Spanish patent 200601651, of Thyssenkrupp, describes a compact walkway based on the concept of a belt formed by pallets of shorter step than the conventional ones. This walkway comprises a drive system which moves the pallets of a moving walkway through drag chains which are directly engaged to the lower part of the traction link chains. The drag chain has separated drag rollers which are made of deformable and elastic materials. The links of the traction chains are connected to one another by joining axes and have teeth and hooks in the lower part for the engagement with the drag chain and the rollers.

In all the aforementioned cases, the drive system includes drag chains which entail a series of problems, such as its lengthening due to use, the need for lubrication, outdoor malfunctioning, difficult maintenance, etc.

As regards escalators, most traction systems are still based on the traditional engagement method between a cogged wheel and a roller chain joined to the steps.

SUMMARY OF THE INVENTION

The present invention refers to a drive system for escalators and moving walkways of the type initially described which entails a modification in the concept of drive of escalators and moving walkways.

The object of the invention is to provide a new drive system for escalators and moving walkways which does not have chains, which will enable to have a cleaner, longer-lasting, easier to maintain and more resistant to outdoor conditions equipment, with respect to the traditional drive systems, or which modifies the existing chain system, which can entail various advantages such as avoiding the need to use rollers in all links or reducing the load of the chain during the turnover, extending its life.

The drive system of the invention is characterized in that it comprises a set of wheels carrying free-rotating rollers, with parallel axes to that of the wheels, the wheels of which are integral to shafts perpendicular to the movement direction of the belt of steps or pallets. The roller wheels and shafts in which they are mounted, are arranged between the forward moving section and the return section of the belt of steps or pallets and engage directly on said steps or pallets through engaging formations of said steps or pallets on the inner surface thereof, or in similar formations in a chain integral to the belt of pallets or steps. The shafts on which the roller wheels are mounted relate to a driving assembly, through a transmission mechanism.

Preferably, the assembly of shafts and the wheels carrying the rollers are located between the moving forward way and the return way of the belt of steps or pallets in the upper head, all of them being driven by an auxiliary system, so that their speed is the same and the necessary speed so that the mean speed of the belt of steps or pallets is the one desired for the escalator and moving walkway. The number of axes can vary according to the needs of the escalator and moving walkway as regards space, power and other factors, the number of axes ranging between one and four.

The wheels carrying the rollers rotate integrally to each one of these axes, having an indeterminate number thereof per axis, so that they engage with the engaging formations of the steps or pallets on their internal surface or reverse, or in similar formations in the chain integral to the belt of pallets or steps. Each link of the belt, step or pallet will have on their internal surface and along it the engaging formations in a number and position coinciding with the wheels of rollers mounted on each shaft.

The wheels will carry a fixed number of rollers engaging with the engaging formations of the steps or pallets or chain. The rollers must be capable of rotating freely with respect to the wheel driving them, for example through their mounting with bearings, bushings, and gudgeons, etc. The size of these elements will depend on that of the engaging formations and the height available for the system, while the total number will depend on the number of shafts and other constructive parameters. The number of rollers will preferably be, initially, the maximum number possible, given the geometry thereof and the space available.

The wheels can have radial arms, on each one of which a roller is mounted, being able to rotate freely, and all of them being located at the same distance from the centre of the wheel.

At least one wheel of rollers, and preferably at least two of these wheels, will be mounted on each shaft.

In the system of the invention the movement of the rollers is only circular, so that the time they push the belt of pallets is less than in a linear drag system, although due to the deformations produced thereof, and the number and geometry of the different elements, they will drive more than one simultaneously.

The wheels of rollers of each one of the sides of the walkway or escalator are angularly located with respect to their own rotating axis, offset with respect to the wheel of rollers of the preceding shaft according to a fixed interval, so that each one of their rollers engages with the engaging formations of the belt of steps or pallets alternatively with respect to the rollers of the rest of the wheels. In this way, a more homogenous division of stress is attained, as well as the deformation of the roller and the simultaneous engaging of the rollers of different shafts. Said offset angle will be the result of dividing the complete angle of a circumference into the total number of rollers in the wheels of rollers of a side of the walkway or escalator.

The rollers of the wheels will be made of an elastically flexible material, but with the appropriate resistance to endure the required stress in the traction of the walkway with a smooth power transmission, without impacts producing noise or vibrations and guaranteeing a homogeneous speed profile, while the profile of the engaging formation of the steps, pallets or chain can be made of different materials, harder ones, such as aluminum or steel.

The transmission mechanism in charge of driving the shafts with wheels of rollers comprises a worm gear, which is perpendicular to said shafts, and a cogged wheel mounted on each shaft, engaging with said worm gear, the shaft being connected to the driving assembly. The cogged wheels will be mounted on an end section or portion of the shafts located outside the moving forward and the return way of the belt of steps or pallets. The constitution of this transmission mechanism, through the worm gear and cogged wheels, integral to the shafts carrying the wheels of rollers, also serves as a reducing gear system which, from the output speed of the motor, provides the turning in the appropriate direction and speed to each one of the traction shafts of the steps or pallets. Due to the usually reduced space available for this transmission mechanism, another option could be placing two motors or sources of movement and consequently two transmission mechanisms, which would also serve as reducing gear systems, each one of which will be coupled to a power source, so that they transmit the total power required to each one of the shafts carrying the wheels of rollers.

Through the application of the transmission mechanism directly on the shafts and wheels or rollers, the use of transmission chains, and the subsequent lubrication, is avoided, so that it constitutes the cleanest, most environmentally-friendly, robust, easy to maintain system which can be operated in adverse atmospheric conditions.

As driving assembly, a motor can be used, which can be of any type typically used in this type of machines, such as for example a squirrel-cage asynchronous triphasic motor. The motor can be located anywhere within the space available for the drive in the upper head, although the preferred location for this system is on one side, parallel to the direction of the walkway moving forward way. Given the reduced space available, it is possible that a motor and transmission mechanism of only up to a certain power can be used, so it is possible to use two motors, one on each side of the walkway and two transmission mechanisms simultaneously.

The motor or motors will drive one or two transmission mechanisms, which will be the ones which will finally transmit the power and movement to the shafts with the wheels of rollers. The transmission mechanism or mechanisms can include a second reduction stage, according to the total value of reduction available and the preferred geometrical arrangement.

The transmission mechanism, which also serves as reducing gear system, can be designed in different ways. It can include a single wormshaft and the same number of crowns as the number of shafts of wheels of rollers which are arranged for the traction of the steps or pallets. Another option is having several transmission mechanisms arranged in series, so that the worm gears of all of them are connected through couplings, elastic ones or of any other type, while each worm gear engages with an output crown, belonging to one of the axes of wheels of rollers.

The transmission and reduction mechanism can also be attained using other types of reducing gears, based on spur or straight-cut, bevel or other gears.

Finally, the transmission mechanism(s) will have in the area located closest to the central part of the walkway, as it has been indicated, a power outlet through the same wormshaft which will serve for the driving of the handrail, with either both of them using the power of one motor or each handrail using one of the motors, if there exist several of them.

BRIEF DESCRIPTION OF THE DRAWINGS

The attached drawings show non-limiting examples of embodiments, of possible drive systems for escalators and moving walkways, constituted according to the invention. In the drawings:

FIG. 1 shows a schematic elevation lateral view of the section of the head of a belt of pallets of a moving walkway which uses 3 drive shafts, with wheels carrying rollers which are offset thirty degrees which engage in engaging formations of said pallets.

FIG. 2 is an upper perspective view of a section of a belt of pallets of a moving walkway according to the same embodiment.

FIG. 3 shows a lower perspective view of the section of the belt of pallets shown in FIG. 2.

FIG. 4 shows a sectional transversal view of one of the pallets, taken according to the cutting line IV-IV of FIG. 3.

DETAILED DESCRIPTION OF AN EMBODIMENT

Figure 5:
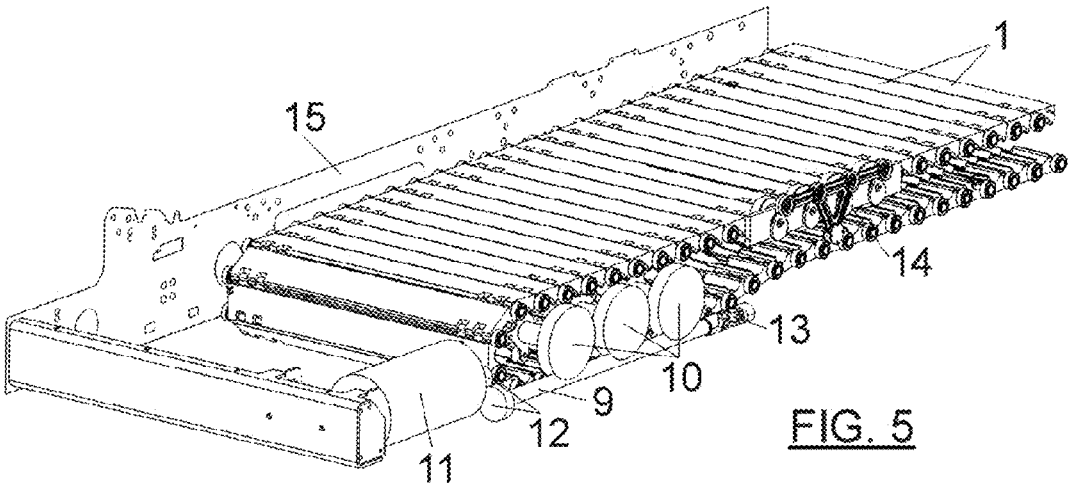
FIG. 5 shows a perspective view of the section of the head of a belt of pallets of a moving walkway including the drive system of the invention through 3 drive shafts.

The constitution, characteristics and advantages of the drive system of the invention can be understood better with the following description, of the embodiment example shown in the aforementioned drawings.

FIG. 1 shows an elevation lateral view of the section of the head of a belt of a moving walkway, of known constitution, comprising pallets 1 which are consecutively joined through axes 2 perpendicular to the movement direction of the belt.

According to the invention, the drive system is arranged between the moving forward and the return way sections of the belt of pallets 1, and it is constituted by wheels 3 which carry free-rotating rollers 4 and are mounted on shafts 5 perpendicular to the movement direction of the belt of pallets 1.

The rollers 4 are mounted on the wheels 3 through axes 6 which are also perpendicular to the movement direction of the belt of pallets 1.

In the example shown the drive system includes three shafts 5, each one of them provided with the wheels 3 with four rollers 4 each, with a total of twelve rollers, being the assembly of shafts 5 and wheels 3 with rollers 4 located between the moving forward and the return way sections of the belt of pallets 1.

As it can be seen in FIGS. 1, 2 and 3, the wheel 3 of rollers 4 engages, through these rollers 4, with engaging formations 7 of the pallets 1 by its interior surface or reverse and which, as it can be seen in FIG. 4, have a curve-concave profile with a radius which approximately coincides with that of the rollers 4, so that through the turning of the shafts 5 the coupling of the roller on the engaging formations 7 is attained, as shown in FIG. 1.

The wheels of consecutive rollers 3 will be located between them with an angular offset of 360°/n, with "n" being the total number of rollers 4 of the different wheels 3. In this case, the roller wheels 3 are angularly located with respect to their axis of rotation, offset with respect to the preceding or following roller wheel of the shaft 5 a thirty-degree angle, resulting from dividing three hundred and sixty degrees into twelve rollers.

The pallets 1, FIG. 4, have an external flat surface, which will define the walkway surface of the belt of the walkway, and in its ends it has drills 8 for the hinge pins 2 between consecutive pallets, having on the back surface or reverse the engaging formation in an approximately centred position.

The set of shafts 5 constitutes the drag system of the belt of pallets 1, the shafts 5 being connected to a driving assembly through a transmission mechanism which, as it can be seen in FIG. 5, is constituted by a worm gear 9, which is parallel to the movement direction of the belt of pallets 1 and is located outside the moving forward way and the return way of said belt, and in a cogged wheel 10 integral to each one of the shafts 5, in an end section protruding from the corresponding side with respect to the belt of pallets 1.

The cogged wheels 10 integral to the shafts 5, together with the worm gear 9, constitute the transmission mechanism between a motor or driving assembly 11 and the shafts 5, also serving as reducing gear system between the motor 11 and said shafts, to attain the desired movement speed of the belt of pallets 1. Based on the number of rollers 4 mounted on each wheel and on the speed and passage values of the pallets 1, the position of the drive shafts 5, the distance between them, the turning speed and the offset between the roller 4 positions of the different wheels 3 are determined, as it can be seen in FIG. 1, to attain the desired movement speed of the belt of pallets 1.

As it can be seen in FIG. 5, the transmission mechanism can include, between the drive motor 11 and the worm gear 9, a first reduction stage comprising cogged wheels 12 engaging with one another.

Also, as it can be seen in FIG. 5, the worm gear 9 can have an outlet 13 for the drive mechanism 14 in charge of the movement of the handrail.

In general, the transmission mechanism can comprise one or more reducing gears of the worm gear-crown type, spur or straight-cut, bevel or other gears, the output stages of which will be connected to each one of the shafts carrying the roller wheels, while they constitute a reducing gear system between the driving assembly and the aforementioned shafts.

The motor 11, constituting the driving assembly, will be preferably arranged next to the belt of pallets 1, inside the enclosure 15 surrounding the belt of pallets 1.

Figure 6:
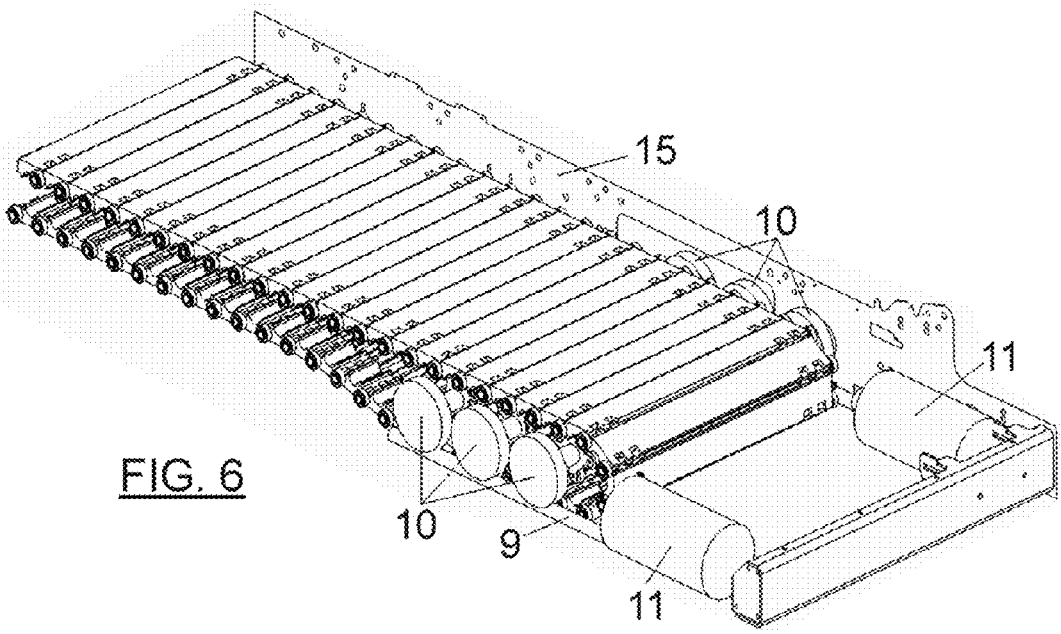
FIG. 6 shows a perspective view similar to FIG. 5, showing an embodiment variant.

As it can be seen in FIG. 6, the driving assembly can include two motors 11, each one of which will drive a transmission mechanism comprising the corresponding worm gear 9 and cogged wheels 10, integral on both sides to the end sections of the shafts 5.

Figure 7:
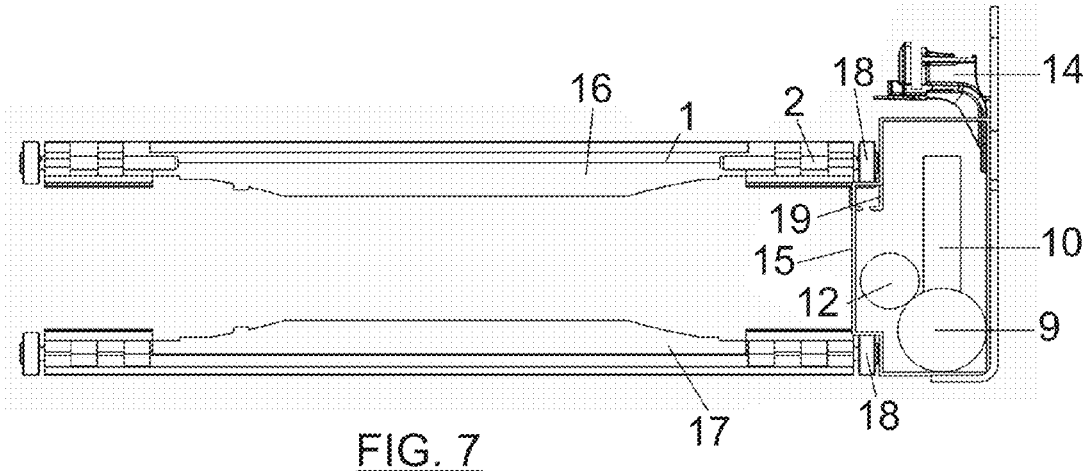
FIG. 7 shows a partial and schematic sectional transversal view of the belt of pallets of FIG. 6.

FIG. 7 shows a schematic and partial transversal sectional view of the moving forward way section 16 and the return way 17 of the belt of pallets 1, said pallets having rollers 18 mounted thereon, through hinge pins 2 between consecutive pallets, said rollers 18 moving on guides 19 running along the entire walkway, including the position of the worm gear 9 and cogged wheels 10 inside the structure 15 of the reducing gear, where a first reduction stage 12 can also be housed.

As it can be seen in FIG. 1, the rollers 4, with free-rotating capacity, can be mounted at the end of the radial arms 20 of the wheels 3.

Figure 8:
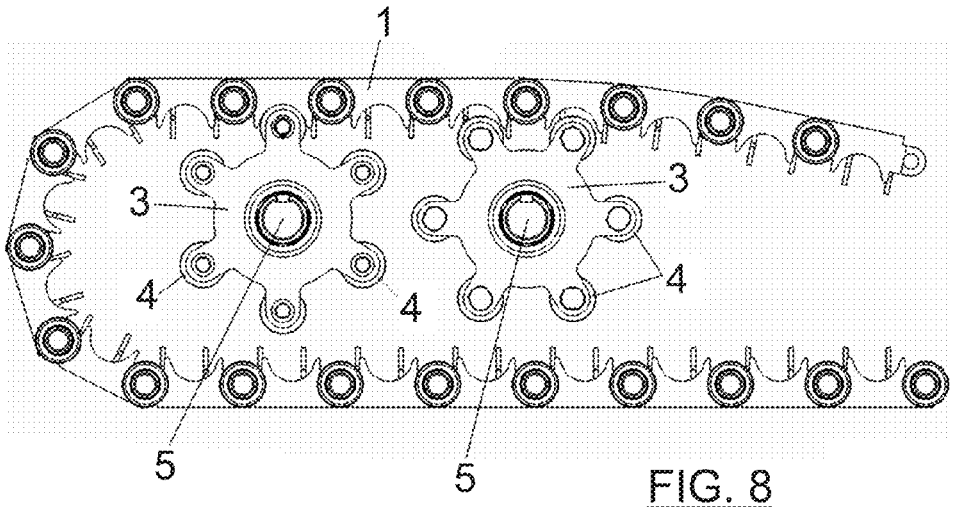
FIG. 8 shows a schematic lateral elevation view of the section of the head of a belt of pallets of a moving walkway which uses two drive shafts with wheels carrying rollers which engage in engaging formations of said pallets.
Figure 9:
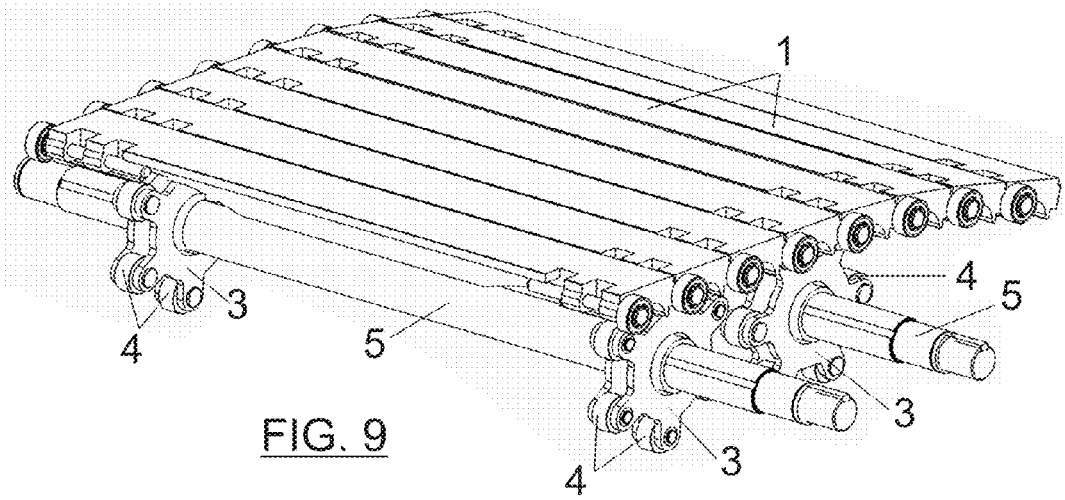
FIG. 9 shows an upper perspective view of a section of a belt of pallets of a moving walkway according to the same embodiment as that of FIG. 8.
Figure 10:
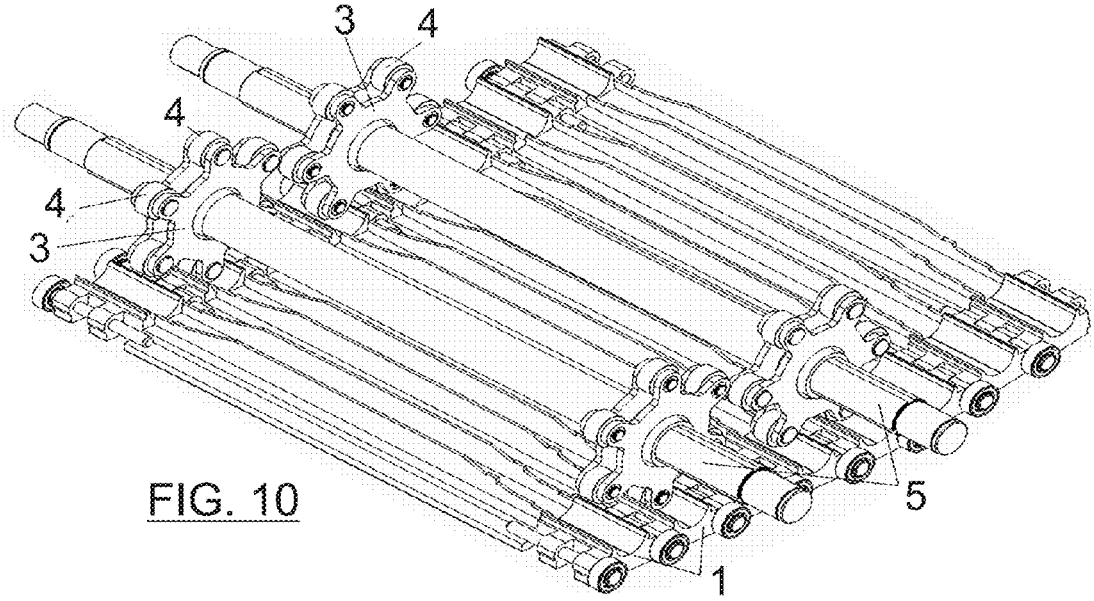
FIG. 10 shows a lower perspective view of the section of the belt of pallets of FIG. 8.

FIGS. 8 to 10 are similar views to those of FIGS. 1 to 3, showing the section of the head of a moving walkway, except in that the drive system is constituted by only two shafts 5, in each one of which there are mounted two wheels 3 carrying free-rotating rollers 4, using the same references to indicate similar parts or components.

The angular offset between the two wheels 3 will also be 30°, resulting from dividing 360° into 12, which is the total number of rollers of the two wheels.

Figure 11:
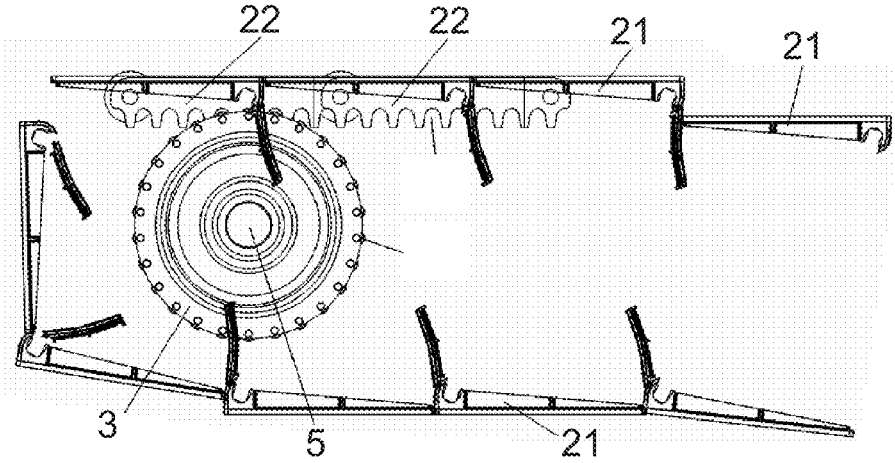
FIG. 11 shows a schematic lateral elevation view of the section of the head of a belt of steps of an escalator which uses a drive shaft with four wheels carrying rollers which engage in engaging formations of the chain of steps.
Figure 12:
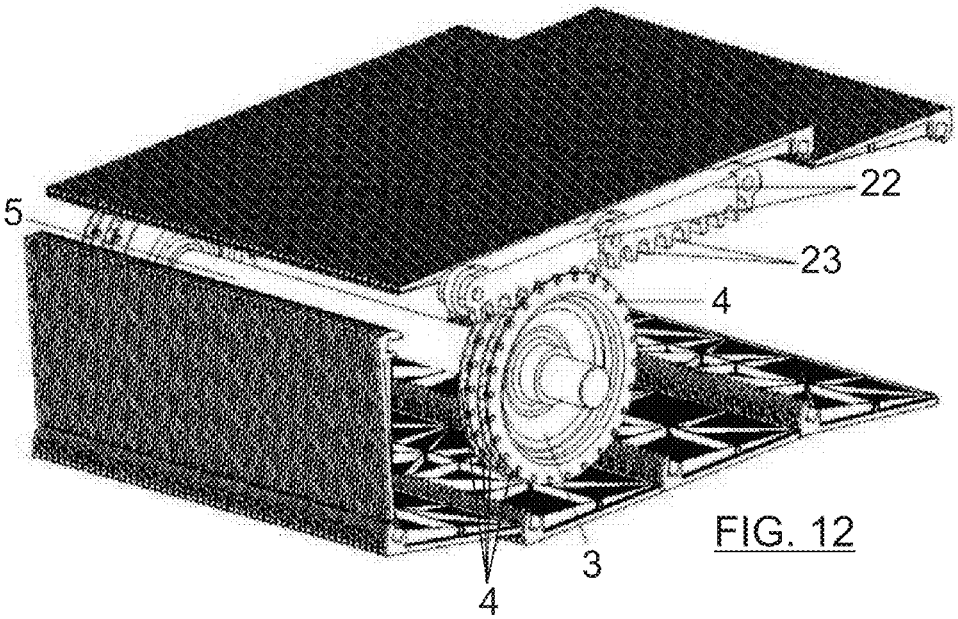
FIG. 12 shows an upper perspective view of a section of a belt of steps of an escalator according to the embodiment of FIG. 11.
Figure 13:
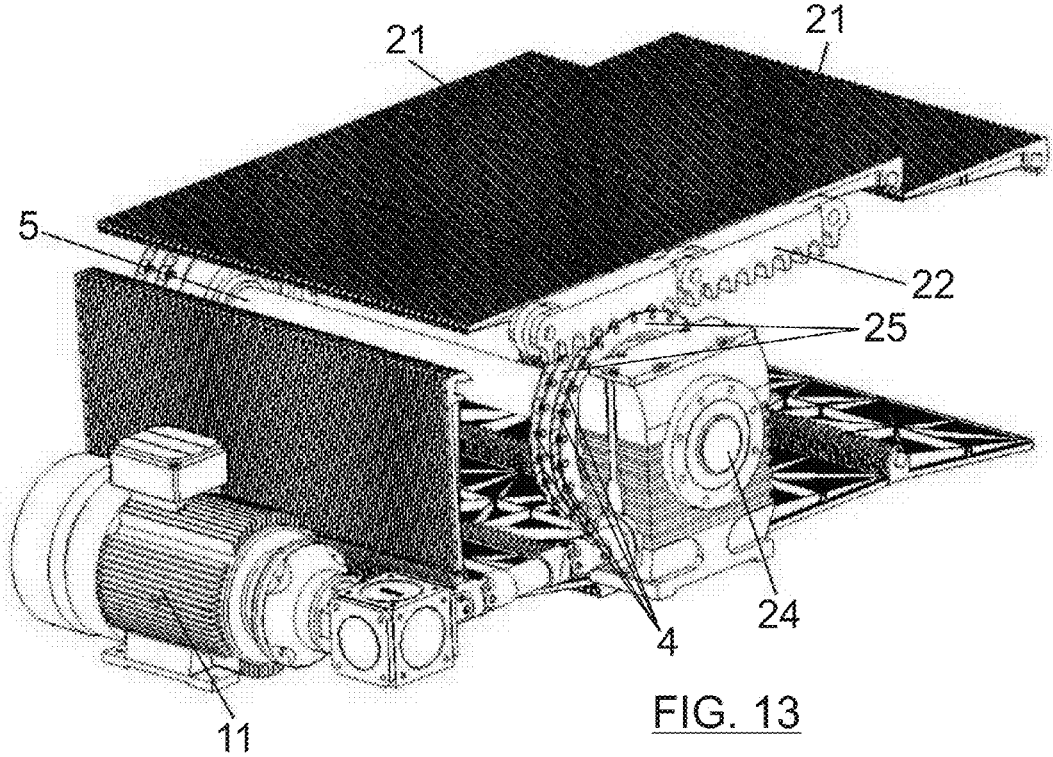
FIG. 13 shows a perspective view of the section of the head of a belt of steps of an escalator including the drive system of the invention through a drive shaft.

FIGS. 11 to 13 show the section of the head of a belt of steps 21 of an escalator, with the drive system of the invention.

Each one of the steps 21, which can have any constitution, is connected on its sides, through any system, to a link 22 having on its inner edge engaging formations 23, equivalent to the engaging formations 7 of the pallets 1, with which the rollers 4 engage, as in FIGS. 1 to 3, being mounted with free-rotating capacity on the wheels 3, which are integral to the shafts 5.

The links 22 can be consecutively joined, configuring a chain on each side of the steps 21, connected to said steps or they can be independent from one another, each one of them being fixed to a step.

In FIG. 13, the transmission and reduction mechanism between the driving assembly, comprising a motor 11, and the shaft 5 is constituted by a reducing gear 24, which substitutes the worm gear 9 and the cogged wheels 2 of FIG. 5. The transmission mechanism can include one or more reducing gears, based on concepts of spur or straight-cut, bevel, or other gears, so that their output stages are connected to each one of the shafts 5 carrying the wheels 3 of rollers 4.

In the embodiment of FIGS. 10 to 12, the drive system includes only one shaft 5, but it is possible to use two or more shafts. Each shaft 5 can have, near each end, a wheel 3 with a double crown 25 of free-rotating rollers 4 or two wheels 3 joined together, each one of them with a crown of rollers. The links 22 will include a double line of engaging formations 23, all of which can be seen better in FIGS. 12 and 13.

The invention claimed is:

1. Drive system for escalators and moving walkways, said escalators and moving walkways being constituted by a belt of steps or pallets which moves on side guides and by a handrail, wherein the drive system comprises a set of wheels carrying free-rotating rollers, with axes parallel to that of the wheels, and one or more shafts perpendicular to the movement direction of the belt of steps or pallets, in which said one or more roller wheels are mounted, whose shafts are arranged between the moving forward and the return way sections of the belt of steps or pallets; and whose wheels carrying rollers engage through the rollers with the steps or pallets of the belt through engaging formations of said belt; the aforementioned shafts being connected to a driving assembly through a transmission mechanism.

2. The system according to claim 1, wherein the engaging formations of the belt of steps or pallets are located on the internal surface of the steps or pallets.

3. The system according to claim 1, wherein the steps or pallets have links on their sides, where the engaging formations of the belt of steps or pallets are located.

4. The system according to claim 3, wherein the links are consecutively joined with one another, configuring a chain at each side of the steps or pallets.

5. The system according to claim 1, wherein the wheels have radial arms, in each one of which a roller, with free rotating capacity, is mounted, and each roller are located at the same distance from the center of the wheel.

6. The system according to claim 1, wherein the transmission mechanism comprises a worm gear, which is perpendicular to the shafts having the roller wheels, and a cogged wheel mounted on each shaft, which engages with said worm gear.

7. The system according to claim 6, wherein the drive system has two independent transmission mechanisms, each one of them located at one side of the belt of steps or pallets, and each transmission mechanism including one or more reducing gears which drive each one of the shafts carrying the roller wheels on both ends of the escalator or moving walkway, each transmission mechanism being driven by an independent driving assembly.

8. The system according to claim 6, wherein at least one of the transmission systems has an outlet or socket for the drive of the handrail.

9. The system according to claim 1, wherein the transmission mechanism comprises one or more reducing gears, whose output stages are connected to each one of the shafts carrying the roller wheels.

10. The system according to claim 1, wherein the wheels of the rollers are angularly offset between them a 360°/n angle, "n" being the total number of rollers of the set of wheels on each side.

11. The system according to claim 1, wherein the rollers of the wheel of rollers are made of a resistant and elastically flexible material.

* * * * *